US009289984B2

(12) United States Patent
Shimizu et al.

(10) Patent No.: US 9,289,984 B2
(45) Date of Patent: Mar. 22, 2016

(54) LIQUID DISCHARGE HEAD AND LIQUID DISCHARGE APPARATUS

(71) Applicant: CANON KABUSHIKI KAISHA, Tokyo (JP)

(72) Inventors: Shigekazu Shimizu, Kitaadachi-gun (JP); Takuya Iwano, Inagi-shi (JP); Kenji Kitabatake, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 126 days.

(21) Appl. No.: 13/962,266

(22) Filed: Aug. 8, 2013

(65) Prior Publication Data

US 2014/0043395 A1 Feb. 13, 2014

(30) Foreign Application Priority Data

Aug. 10, 2012 (JP) ..... 2012-178276

(51) Int. Cl.
*B41J 2/135* (2006.01)
*B41J 2/175* (2006.01)

(52) U.S. Cl.
CPC ..... *B41J 2/135* (2013.01); *B41J 2/1752* (2013.01); *B41J 2/17513* (2013.01); *B41J 2/17563* (2013.01)

(58) Field of Classification Search
CPC ..... B41J 2002/14169; B41J 2202/07; B41J 2/175; B41J 2/17513; B41J 2/17523
USPC ..... 347/85, 86, 44, 92
See application file for complete search history.

(56) References Cited

U.S. PATENT DOCUMENTS

| | | | | | |
|---|---|---|---|---|---|
| 5,677,718 | A * | 10/1997 | Crawford et al. | | 347/92 |
| 5,963,239 | A * | 10/1999 | Nishioka et al. | | 347/92 |
| 6,003,971 | A * | 12/1999 | Hanks et al. | | 347/43 |
| 6,193,356 | B1 * | 2/2001 | Takata | | 347/30 |
| 7,090,334 | B2 * | 8/2006 | Tomizawa | B41J 2/1404 | 347/47 |
| 2005/0146577 | A1 * | 7/2005 | Sasaki et al. | | 347/86 |
| 2006/0187279 | A1 * | 8/2006 | Childs et al. | | 347/85 |
| 2008/0278551 | A1 * | 11/2008 | Xu | B41J 2/075 | 347/85 |
| 2009/0244181 | A1 * | 10/2009 | Kurobe | | 347/44 |

(Continued)

FOREIGN PATENT DOCUMENTS

| | | | |
|---|---|---|---|
| CN | 1172016 | A | 2/1998 |
| CN | 101602286 | A | 12/2009 |
| CN | 101879816 | A | 11/2010 |

(Continued)

*Primary Examiner* — Matthew Luu
*Assistant Examiner* — Patrick King
(74) *Attorney, Agent, or Firm* — Canon U.S.A., Inc. IP Division

(57) ABSTRACT

A liquid discharge head includes a liquid discharge substrate configured to discharge liquid; a flow channel configured to supply the liquid to the liquid discharge substrate and including a first flow channel portion, a second flow channel portion communicating with the first flow channel portion and extending in a direction intersecting a predetermined direction in which the first flow channel portion extends, and a third flow channel portion provided on a downstream side of a position of communication between the first and second flow channel portion with respect to a flow of liquid flowing in the first flow channel portion and communicating with the first flow and second flow channel portion, the third flow channel portion including a first wall defining an end portion of a flow channel and a second wall having an inclined surface inclining toward a wall which defines the second flow channel portion.

18 Claims, 13 Drawing Sheets

(56) References Cited

U.S. PATENT DOCUMENTS

| | | | | |
|---|---|---|---|---|
| 2009/0268000 | A1* | 10/2009 | Childs et al. | 347/86 |
| 2010/0171798 | A1* | 7/2010 | Yamaguchi | B41J 2/16532 347/85 |

FOREIGN PATENT DOCUMENTS

| | | | |
|---|---|---|---|
| JP | H09-131890 | A | 5/1997 |
| JP | 2002-144605 | A | 5/2002 |
| JP | 2012-051197 | A | 3/2012 |

* cited by examiner

LIQUID DISCHARGE HEAD AND LIQUID DISCHARGE APPARATUS

BACKGROUND OF THE INVENTION

1. Field of the Invention

This disclosure relates to a liquid discharge head configured to discharge liquid and a liquid discharge apparatus.

2. Description of the Related Art

Ink (liquid) is supplied from an ink tank in which the ink is stored to an ink jet recording head (liquid discharge head) to be mounted on an ink jet recording apparatus (hereinafter, also referred to as a recording apparatus) representative as a liquid discharge apparatus. Japanese Patent Laid-Open No. 2002-144605 describes a configuration in which ink supplied from an ink tank passes through a flow channel provided in a flow channel member and is supplied to an ink discharge portion.

In order to eliminate time and labor of a user for mounting the ink jet recording head on the recording apparatus, there is a case where the recording apparatus is shipped in a state in which the ink jet recording head is mounted. In order to prevent ink from being leaked during transportation, the ink jet recording head is kept empty without being filled with ink when being transported. Then, at the beginning of usage of the recording apparatus, ink is sucked from an ink discharge portion of the ink jet recording head and the interior of the ink jet recording head is initially filled with ink. At this time, since the flow channel in the empty state has a dry inner wall, the ink can hardly be adapted well to the inner wall, so that the following problems may occur at a bent portion of the flow channel.

In other words, as illustrated in FIG. 8 of Japanese Patent Laid-Open No. 2002-144605, in the flow channel provided with a bent portion, separation of a boundary layer may occur when being initially filled with ink in the bent portion, and an air bubble may be generated and stay thereon. If the air bubble stays in the interior of the ink jet recording head, there is a risk of printing failure due to insufficient supply of ink to an ink discharge portion.

The probability of occurrence of separation of the boundary layer is increased with increase in flow speed of the ink when sucking the ink. Therefore, the problem of stay of the air bubble is improved to some extent by a method of lowering the flow speed as much as possible. However, if the sucking speed is low, waiting time until the apparatus becomes available for printing at the beginning of use becomes long.

SUMMARY OF THE INVENTION

The disclosure provides a liquid discharge head which may suppress generation of an air bubble at a bent portion of a flow channel.

A liquid discharge head includes a liquid discharge substrate configured to discharge liquid a flow channel configured to supply the liquid to the liquid discharge substrate, the flow channel including a first flow channel portion, a second flow channel portion communicating with the first flow channel portion and extending in a direction intersecting a predetermined direction in which the first flow channel portion extends, and a third flow channel portion provided on the downstream side of the position where the first flow channel portion and the second flow channel portion communicate with each other with respect to the flow of liquid flowing in the first flow channel portion and communicating with the first flow channel portion and the second flow channel portion, the third flow channel portion including a first wall defining an end portion of the flow channel with respect to the predetermined direction and a second wall having an inclined surface inclining toward a wall which defines the second flow channel portion connected to the first flow channel portion and connecting the first wall and the second flow channel portion.

A liquid discharge head which may reduce generation of an air bubble at a bent portion in a flow channel is provided.

Further features of the present invention will become apparent from the following description of exemplary embodiments with reference to the attached drawings.

DESCRIPTION OF THE EMBODIMENTS

Aspects of the invention will be described.

First Embodiment

Figure 1:
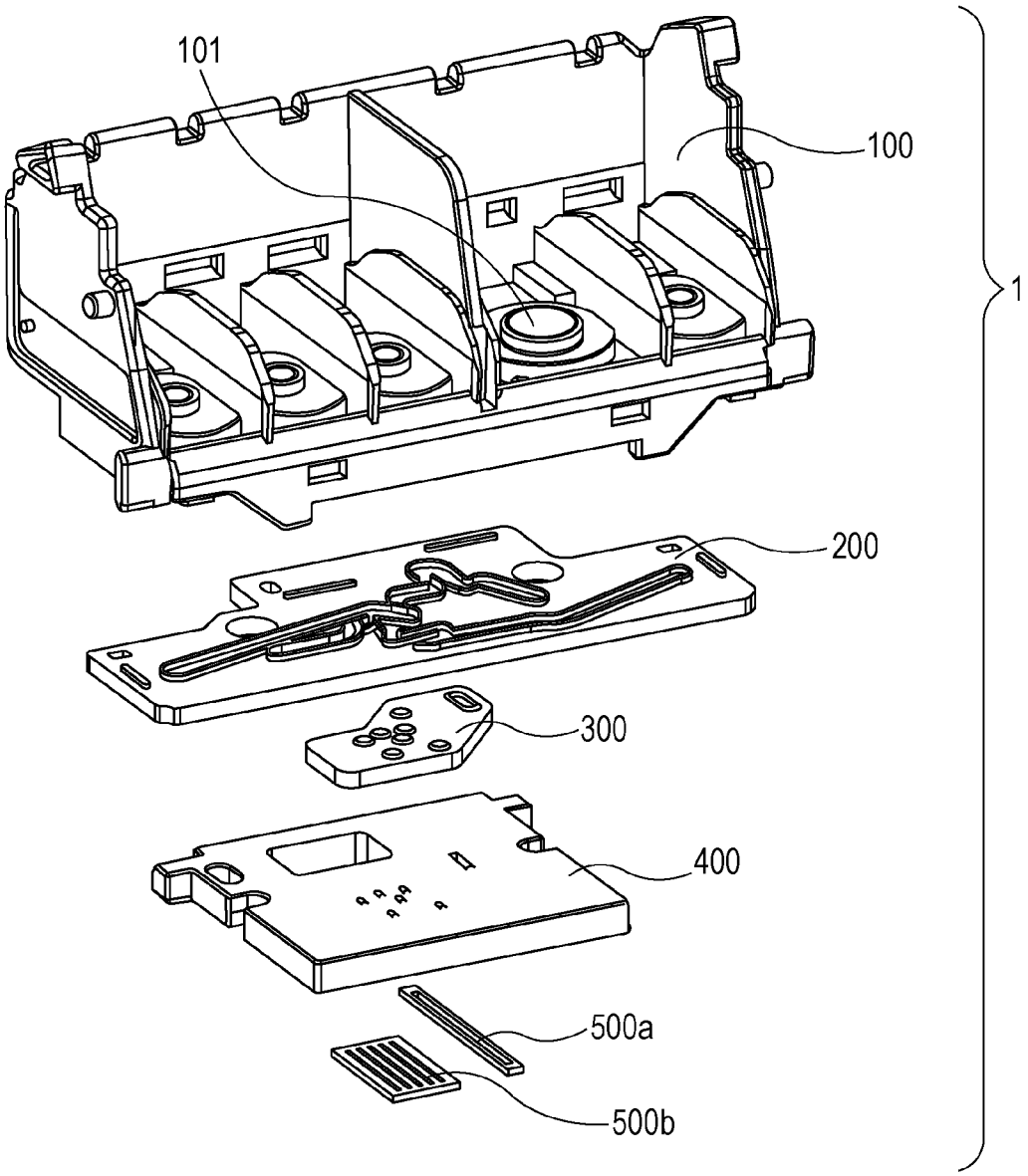
FIG. 1 is an exploded perspective view illustrating an ink jet recording head.

FIG. 1 is an exploded perspective view of an ink jet recording head 1 as a liquid discharge head. The ink jet recording head 1 according to a first embodiment includes recording element rows for pigment black ink and four colors of dye ink, and flow channels for supplying ink from ink tanks (not illustrated) for storing ink for the respective recording element rows.

Figure 2A:
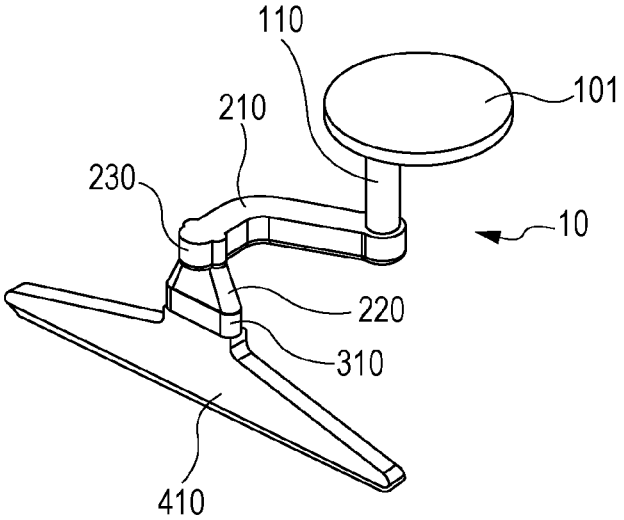
FIGS. 2A to 2C are drawings illustrating a flow channel according to a first embodiment.
Figure 2B:
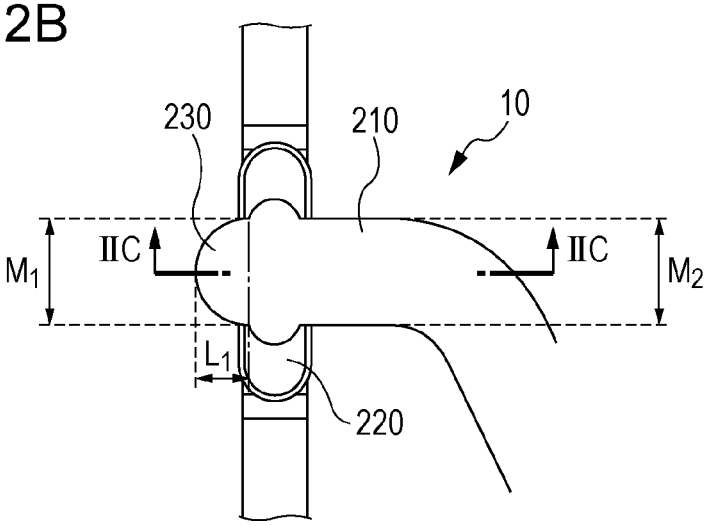
Figure 2C:
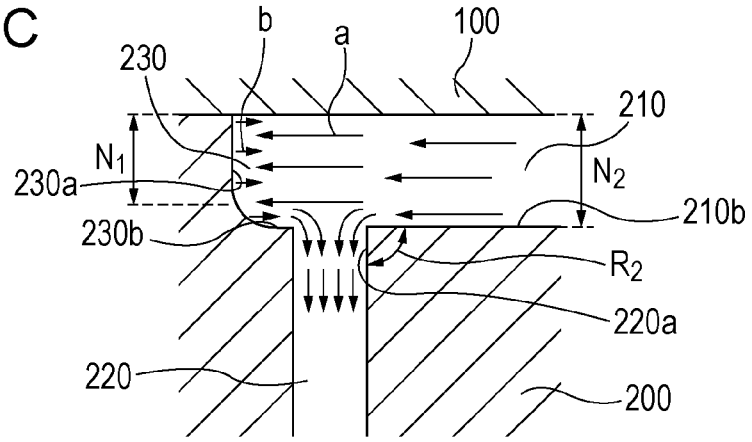

A flow channel 10 for pigment black ink from among a plurality of flow channels will be illustrated in FIGS. 2A to 2C. FIG. 2A is a schematic perspective view for explaining the shape of the flow channel 10, FIG. 2B is a top view illustrating part of the flow channel 10, and FIG. 2C is a cross-sectional view taken along the line IIC-IIC in FIG. 2B. FIGS. 2A and 2B illustrate inner walls which define the flow channel 10, and FIG. 2C illustrates part of a first flow channel forming member 100 and part of a second flow channel forming member 200 described later in addition to the flow channel 10.

As illustrated in FIG. 1, the ink jet recording head 1 includes the first flow channel forming member 100, the second flow channel forming member 200, a seal member 300, a supporting member 400, and a recording element substrates 500 (500*a* and 500*b*) (liquid discharge substrates) as liquid discharging portions. The first flow channel forming member 100, the second flow channel forming member 200, the seal member 300, and the supporting member 400 are flow channel members which define the flow channel 10 for supplying ink from the ink tank to the recording element rows provided on the recording element substrates 500*a* and 500*b*.

The first flow channel forming member 100 is a tank holder for mounting the ink tank. The second flow channel forming member 200 is a member configured to be joined to the first flow channel forming member 100 and define the flow channel as described later. The seal member 300 is a member being sandwiched between the second flow channel forming member 200 and the supporting member 400 for preventing ink leakage from between the both members. The supporting member 400 is a member to which the recording element substrates 500*a* and 500*b* are bonded.

The recording element substrates 500*a* and 500*b* are substrates provided with recording element rows including a plurality of recording elements (not illustrated) as energy generating elements for generating energy for discharging ink. The recording element substrates 500*a* and 500*b* are provided with discharge ports (not illustrated) for discharging ink so as to correspond to the recording element. The pigment black ink is supplied to the recording element substrate 500*a*, and dye ink is supplied to the recording element substrate 500*b*. The length of the recording element row, which corresponds to a recordable width of the recording element substrate 500*a*, is longer than that of the recording element substrate 500*b*.

Referring now to FIG. 1 and FIG. 2A, respective flow channel portions which constitute the flow channel 10 for pigment black ink will be described. The first flow channel forming member 100 is formed with a flow channel portion 110 where ink supplied from the ink tank and passed through a filter 101 provided on the first flow channel forming member 100. The second flow channel forming member 200 is formed with a second flow channel portion 220 configured to supply ink to a flow channel 310 in the seal member 300. A groove, which corresponds to a flow channel is formed on the second flow channel forming member 200, and a first flow channel portion 210 which connects the flow channel portion 110 and the second flow channel portion 220 is defined by bonding the periphery of the groove and the first flow channel forming member 100 by ultrasonic welding or the like. The second flow channel portion 220 communicates with a liquid chamber 410 provided on the supporting member 400 via the flow channel 310 provided on the seal member 300. The ink supplied to the liquid chamber 410 passes through supply ports or flow channels provided in the interiors of the recording element substrates 500*a* and 500*b*, and is discharged from the discharge ports.

Here, in the first embodiment, the first flow channel portion 210 is a flow channel in which the ink flows in the horizontal direction in a state in which the ink jet recording head 1 is used. The second flow channel portion 220 is a flow channel in which the ink flows in the direction of a gravitational force in a state in which the ink jet recording head 1 is used. The relationship between the direction of flow of the ink and the state in which the ink jet recording head 1 is used is not limited to the configuration of the first embodiment. In the first embodiment, a bent angle $R_2$ between the first flow channel portion 210 and the second flow channel portion 220 is 90° as illustrated in FIG. 2C, but not limited thereto. In other words, the bent angle $R_2$ may be an acute angle or an obtuse angle as long as the second flow channel portion 220 extends in the direction intersecting the predetermined direction extending in the first flow channel portion 210.

Subsequently, a third flow channel portion 230 provided so as to project from a terminal end of the first flow channel portion 210 will be described with reference to FIGS. 2A to 2C. The third flow channel portion 230 is connected to the first flow channel portion 210 and provided on a downstream side in the direction of flow of the ink in the first flow channel portion 210 with respect to a position where the first flow channel portion 210 and the second flow channel portion 220 are connected. The third flow channel portion 230 is provided with a wall 230*a* (first wall) that defines a terminal end of the third flow channel portion 230 in the direction of flow of the ink in the first flow channel portion 210.

Here, the third flow channel portion 230 in the first embodiment is formed into a semi-circular shape viewed from top as illustrated in FIG. 2B. A bottom surface 210*b* of the first flow channel portion 210 and a bottom surface 230*b* of the third flow channel portion 230 are provided at the same level.

Figure 3A:
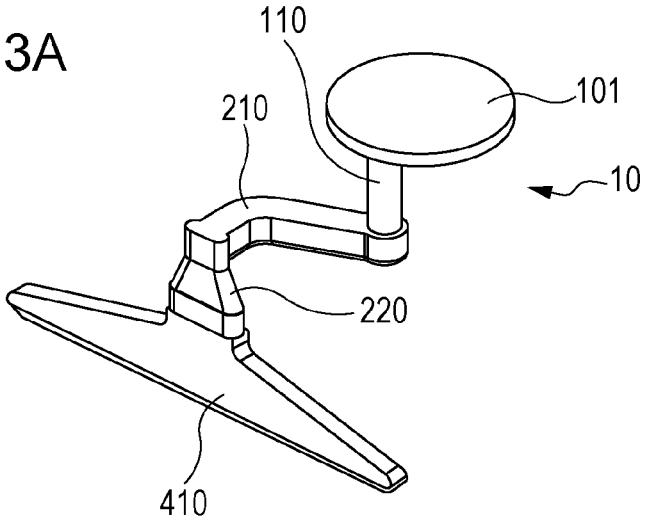
FIGS. 3A to 3C are drawings illustrating a comparative example with respect to the first embodiment.
Figure 3B:
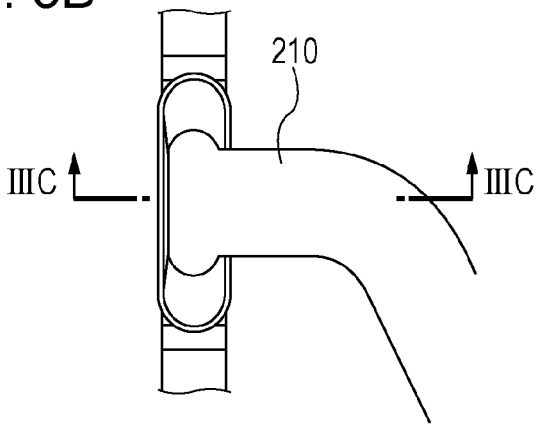
Figure 3C:
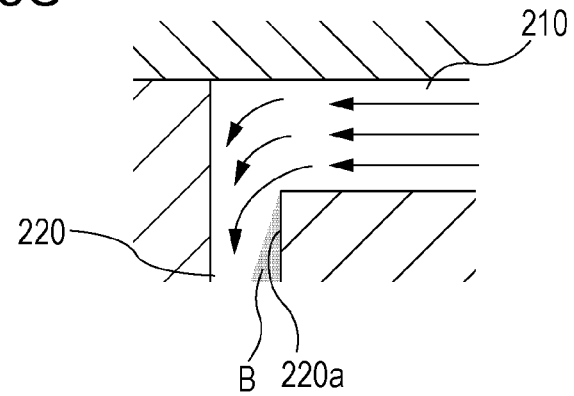

FIGS. 3A to 3C are drawings illustrating a comparative example of the first embodiment, and FIGS. 3A to 3C correspond respectively to FIGS. 2A to 2C. In the comparative example, the third flow channel portion 230 is not provided in the flow channel 10, and a wall of the second flow channel portion 220 is formed in flush with a wall which defines the terminal end of the first flow channel portion 210.

An operation of the third flow channel portion 230 will be described with reference to FIGS. 2A to 3C.

When the ink flows from the first flow channel portion 210 into the second flow channel portion 220, the direction of flow of the ink changes from the horizontal direction into the vertical direction. In this manner, at the bent portion of the flow channel 10 where the direction of flow of the ink changes, when the wall which defines the terminal end of the first flow channel portion 210 and the wall which defines the second flow channel portion 220 are provided in flush with each other as illustrated in FIGS. 3A to 3C, the following phenomenon may occur. In other words, when the direction of flow of the ink is changed, since kinetic energy of the ink flowing through the first flow channel portion 210 toward the second flow channel portion 220 is large, an ink layer around the corner is susceptible to be sheared from an inside face of a wall 220*a*, that is, the ink layer near the corner is susceptible to separation of the boundary layer. Consequently, as illustrated in FIG. 3C, from the portion where the boundary of the ink layer is sheared, an air bubble B may be generated and stayed in the flow channel portions. Thus, the ink cannot be supplied sufficiently to the ink discharge portion, whereby a printing failure may occur.

Figure 13:
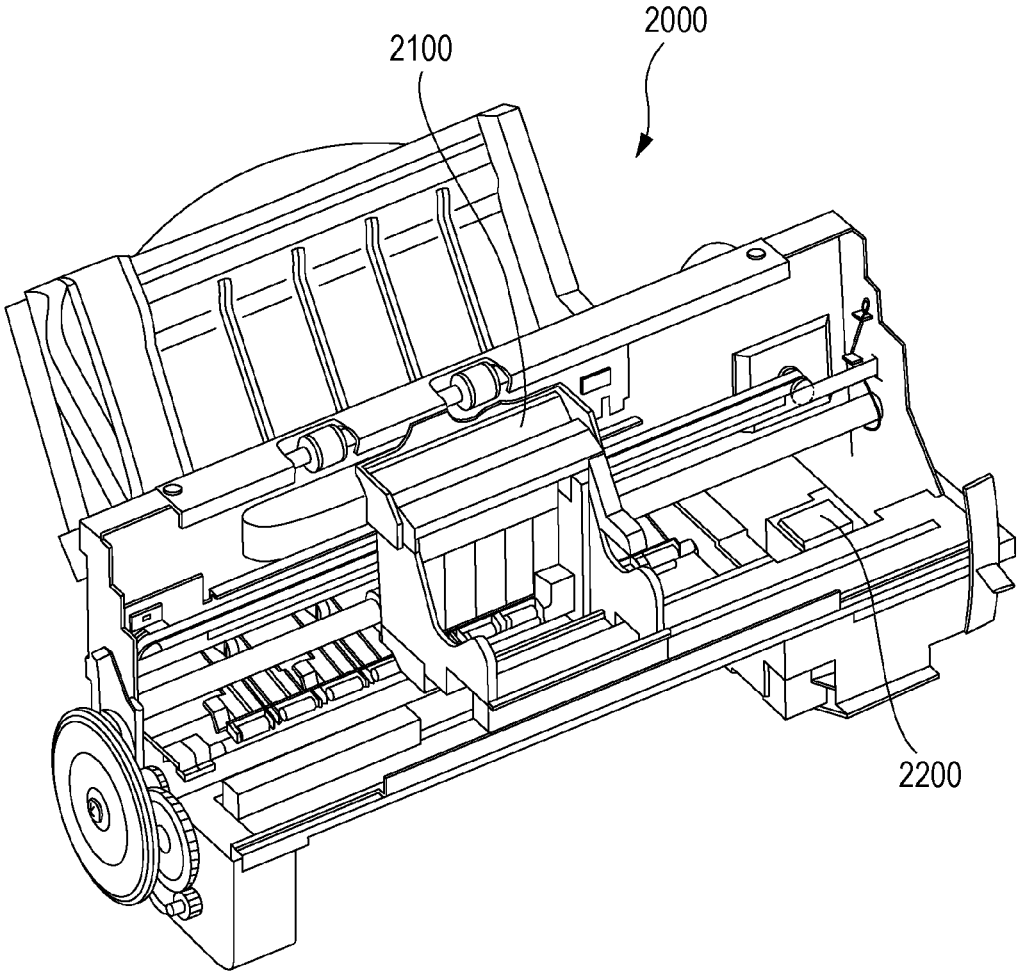
FIG. 13 is a perspective view of an ink jet recording apparatus.

FIG. 13 is a perspective view illustrating an ink jet recording apparatus 2000 as the liquid discharge apparatus on which the ink jet recording head 1 is mounted. The ink jet recording head 1 is mounted on a carriage 2100 and used for scanning.

A cleaning mechanism 2200 performs cleaning of the ink jet recording head 1, and includes a pump, a cap, and the like as a suction unit. The ink is sucked from the ink jet recording head 1 via the cap by the pump. The cap is driven so as to be movable upward and downward. When the recording operation is not performed, the cap may move to the uppermost position to cover the discharge port of the ink jet recording head 1 for protection or the cap may perform restoration by sucking operation.

In particular, in a state in which the inner wall of the flow channel 10 is dry when the flow channel is initially filled by sucking the ink at a high negative pressure such as 10000 Pa or higher by the suction unit, the kinetic energy of the ink flowing in the first flow channel portion 210 is increased, and hence the probability of occurrence of the above-described phenomenon is increased.

Therefore, the occurrence of the phenomenon as described above may be suppressed by providing the third flow channel portion 230 so as to project from the terminal end of the first flow channel portion 210 as illustrated in FIGS. 2A to 2C. In other words, when the ink flowing in the first flow channel portion 210 moves to the wall 230*a* of the third flow channel portion 230, the ink reverses its direction to flow back as a reaction. Thus, a flow indicated by an arrow b is generated against a flow indicated by an arrow a in FIG. 2C (hereinafter, the arrow a is referred to as "normal direction"). In this case, in the first embodiment, the flow of the ink having a vector in the opposite direction is easily developed by the bottom surface 230*b* of the third flow channel portion 230 in comparison with the configuration of the comparative example. By the reversed flow of the ink having the vector in the opposite direction against ink flowing in the normal direction, the kinetic energy of the ink flowing in the normal direction is attenuated. Accordingly, the generation of the air bubble on the wall 220*a* of the second flow channel portion 220 in the vicinity of the bent portion of the flow channel 10 is suppressed.

The value of a depth $L_1$ of the third flow channel portion 230 (that is, the radius of the third flow channel portion 230 in the first embodiment) has a correlation with a flow channel width $M_2$ of the first flow channel portion 210, and is preferably set to $M_2/2 \leq L_1 \leq 3M_2/2$, and more preferably, is on the order of 0.5 times of the $M_2$.

A width $M_1$ of the third flow channel portion 230 is preferably set to be $M_2 \leq M_1 \leq 3M_2/2$ with respect to the width $M_2$ of the first flow channel portion 210 in order to receive the kinetic energy of the ink sufficiently, and more preferably, on the order of 1.0 times of the $M_2$.

In the first embodiment, the depth $L_1$ of the third flow channel portion 230 is set to 0.85 mm, the flow channel width $M_1$ of the third flow channel portion 230 and the flow channel width $M_2$ of the first flow channel portion 210 are set to be 1.7 mm, and a flow channel height $N_2$ of the first flow channel portion 210 is set to 1.53 mm.

The cross-sectional shape of the third flow channel portion 230 is a semi-circular shape in the first embodiment. However, this shape is not specifically limited and may be shapes described in embodiments described below.

The cross-sectional shape of the second flow channel portion 220 is an oblong shape as illustrated in FIG. 2B. However, this shape is not specifically limited and may be an oval shape or a perfect circle. The second flow channel portion 220 is tapered which is increased in cross-section toward the direction of travel of ink. However, the invention is not limited to the tapered shape, and may be straight.

The flow channel 10 for pigment black ink has been described. The configuration described above may be applied to flow channels for other types of ink.

Second Embodiment

Figure 4A:
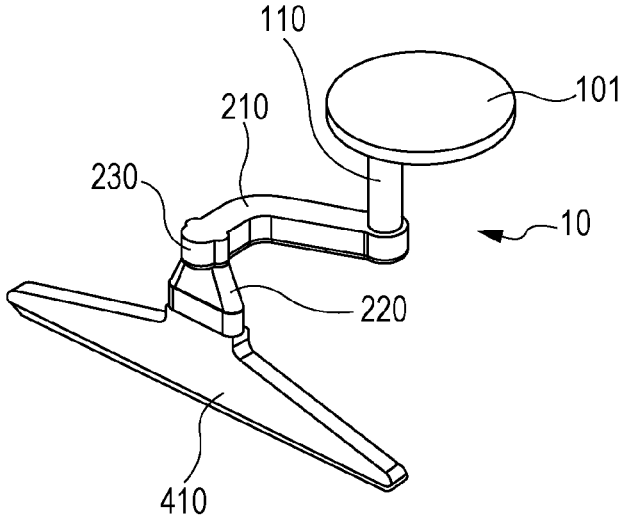
FIGS. 4A to 4C are drawings illustrating a flow channel according to a second embodiment.
Figure 4B:
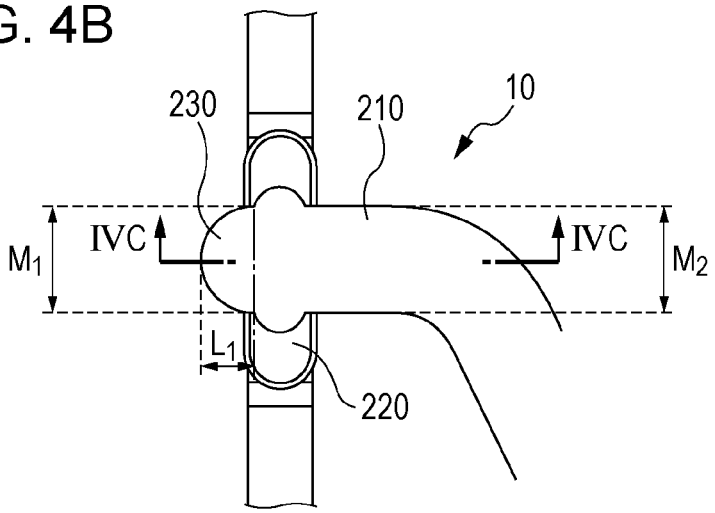
Figure 4C:
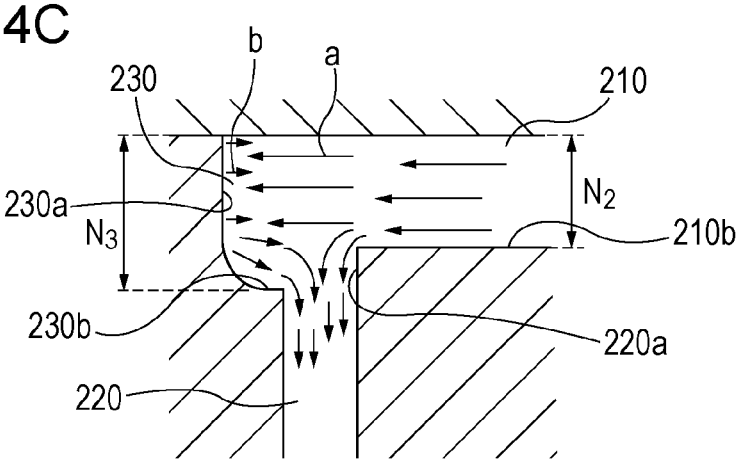

Subsequently, a second embodiment will be described. FIGS. 4A to 4C illustrate the flow channel 10 for pigment black ink of the second embodiment. FIG. 4A is a schematic perspective view for explaining the shape of the flow channel 10, FIG. 4B is a top view illustrating part of the flow channel 10, and FIG. 4C is a cross-sectional view taken along the line IVC-IVC.

The position of the bottom surface 230*b* of the third flow channel portion 230 (FIG. 4C) in the second embodiment is different from the first embodiment. However, the basic configuration is the same as that of the first embodiment.

In the second embodiment, the dimensional relationship between a height $N_3$ of the third flow channel portion 230 and the height $N_2$ of the first flow channel portion 210 at a connecting portion of the first flow channel portion 210 and the second flow channel portion 220 in order to further restrain the generation of the air bubble at the time of initial filling is set to $N_2 < N_3$. Upper surfaces of the first flow channel portion 210 and the third flow channel portion 230 are provided at the same level, and the bottom surface 230*b* of the third flow channel portion 230 is provided at a position lower than the bottom surface 210*b*of the first flow channel portion 210.

In the same manner as that in the first embodiment, when the ink flowing in the first flow channel portion 210 moves to the wall 230*a* of the third flow channel portion 230, the ink reverses its direction to flow back as a reaction. Thus, a flow indicated by an arrow b is generated against a flow indicated by an arrow a in FIG. 4C. By the reversed flow of the ink having the vector in the opposite direction against ink flowing in the normal direction, the kinetic energy of the ink flowing in the normal direction is attenuated.

In the second embodiment, the bottom surface 230*b* of the third flow channel portion 230 is provided at a level lower than the bottom surface 210*b* of the first flow channel portion 210. Accordingly, the ink having the vector in the opposite direction moves against the ink flowing in the normal direction in the area susceptible to the separation of the boundary layer, that is, at a position near the wall 220*a* of the second flow channel portion 220 in the vicinity of the connecting portion of the first flow channel portion 210 and the second flow channel portion 220. Therefore, generation of the air bubble can further be prevented.

Figure 5:
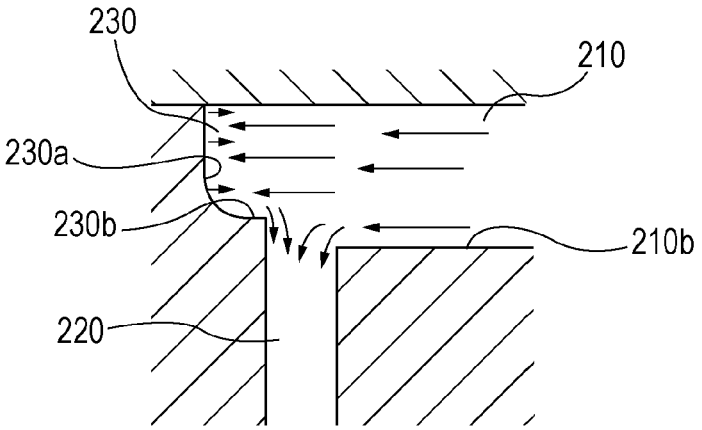
FIG. 5 is a drawing illustrating a modification of the second embodiment.

As in the modification illustrated in FIG. 5, the bottom surface 230*b* of the third flow channel portion 230 may be located at a level higher than the bottom surface 210*b* of the first flow channel portion 210 unlike the first embodiment and the second embodiment. At this time as well, the kinetic energy of the ink flowing in the normal direction may be attenuated by the ink which moves to the wall 230*a* of the third flow channel portion 230 and reverses its direction to flow back. However, the ink having the vector in the opposite direction moves against the ink flowing in the normal direction at a position farther from the area which is susceptible to the separation of the boundary layer than the case of the first embodiment. Therefore, in terms of restriction of generation of the air bubble, the configuration illustrated in FIG. 4C is further preferable.

A preferable range of the depth $L_1$ of the third flow channel portion 230 and the width $M_1$ of the third flow channel portion 230 are the same as those of the first embodiment.

Third Embodiment

Subsequently, a third embodiment will be described with reference to FIGS. 6A to 8D.

Figure 6A:
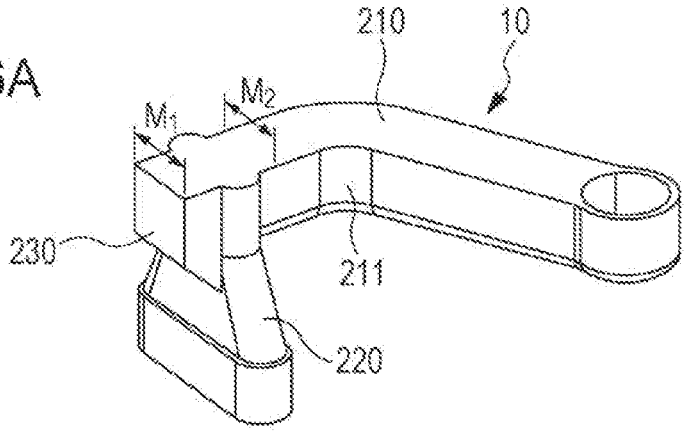
FIGS. 6A to 6C are drawings illustrating a flow channel according to a third embodiment.
Figure 6B:
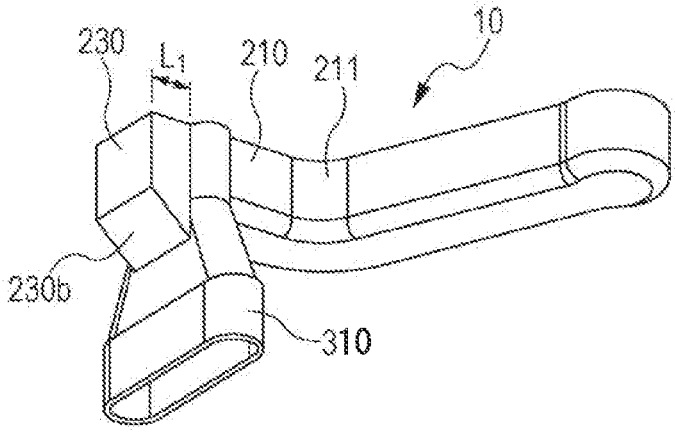
Figure 6C:
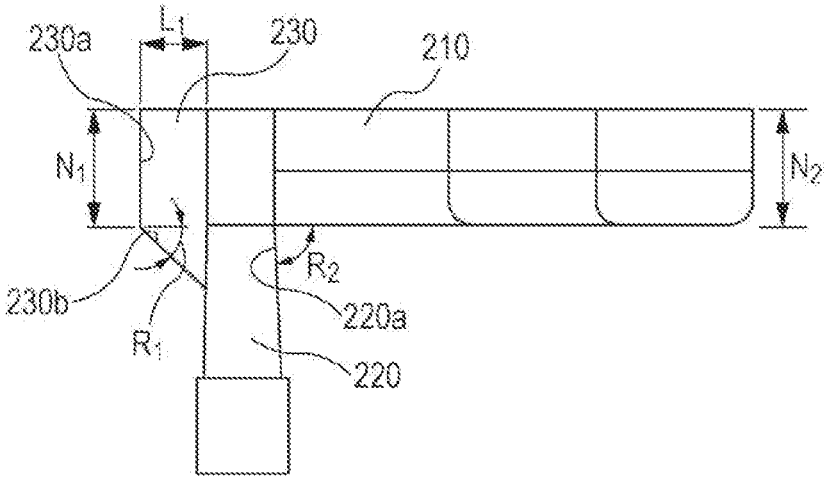

FIGS. 6A to 6C illustrate part of the flow channel 10 for pigment black ink of the third embodiment. FIGS. 6A and 6B are schematic perspective views and FIG. 6C is a side view.

As illustrated in FIG. 6C, the third embodiment is different from the first and second embodiments in that the bottom surface 230*b* (the second wall) of the third flow channel portion 230 in the third embodiment is an inclined surface. However, the basic configuration is the same as that of the first and second embodiments.

FIGS. 8A to 8D are drawings illustrating a state in which ink I flows in the flow channel 10 of the third embodiment. In the same manner as the first and second embodiments, the ink supplied through the first flow channel portion 210 enters the third flow channel portion 230, and interflows with ink reversed by the wall 230*a* of the third flow channel portion 230. Accordingly, kinetic energy of the ink in the normal direction is attenuated.

Figure 8A:
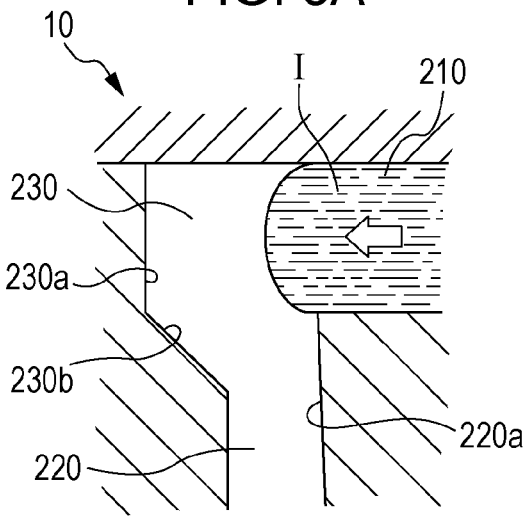
FIGS. 8A to 8D are drawings for illustrating an ink flow in a flow channel according to the third embodiment.
Figure 8B:
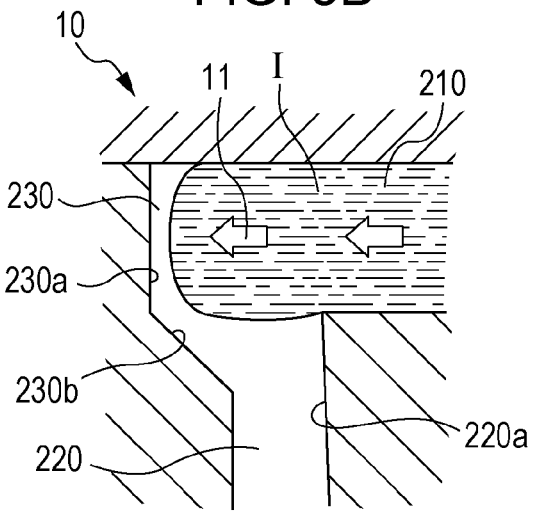
Figure 8C:
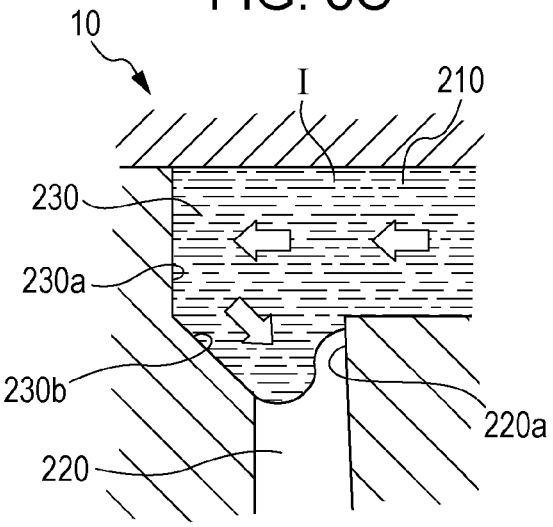
Figure 8D:
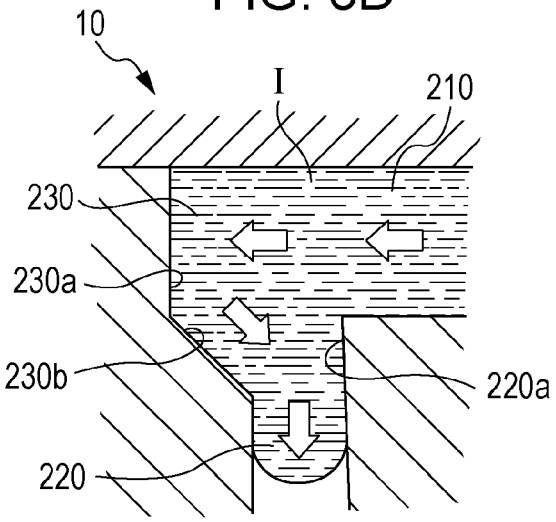

Furthermore, in the third embodiment, the bottom surface 230*b* (the second wall) of the third flow channel portion 230 communicating with the second flow channel portion 220 is an inclined surface inclining toward the wall 220*a* of the second flow channel portion 220 as illustrated in FIG. 6C. In other words, the bottom surface 230*b* is inclined with respect to the direction in which the first flow channel portion 210 extends and the direction in which the second flow channel portion 220 extends. The bottom surface 230*b* is inclined toward the wall 220*a* provided at a position on the uppermost stream side with respect to the direction of flow of ink flowing in the first flow channel portion 210, which is part of the wall that defines the second flow channel portion 220. Therefore, since the flow of the ink is deviated in the direction along the bottom surface 230*b* of the third flow channel portion 230 as illustrated in FIGS. 8C and 8D, the ink flows toward an area which is susceptible to the separation of the boundary layer in the wall 220*a* of the second flow channel portion 220. Accordingly, the generation of the air bubble on the wall 220*a* of the second flow channel portion 220 in the vicinity of the bent portion of the flow channel 10 is restrained.

An angle of inclination $R_1$ (FIG. 6C) of the bottom surface 230*b* of the third flow channel portion 230 is preferably an angle which causes the ink to flow toward the area which is susceptible to the separation of the boundary layer in the second flow channel portion 220. In other words, the angle of inclination $R_1$ is determined in accordance with the balance between the depth $L_1$ of the third flow channel portion 230 and a height $N_1$ of the wall of the third flow channel portion 230. According to the result of a theoretical operation performed by the inventors, the angle of inclination R1 was preferably set to $0<R_1\leq R_2/2$ and, more preferably, to approximately $30°\leq R_1\leq 60°$. In the third embodiment, the most preferable value was $R_1=45°$ when $L_1=M_2/2$, $N_1=N_2$.

The height $N_1$ of the wall 230*a* of the third flow channel portion 230 is preferably set to $N_2/2\leq N_1\leq N_2$ with respect to the flow channel height $N_2$ of the first flow channel portion 210 in order to attenuate the kinetic energy of the ink sufficiently and deviate the same toward the wall 220*a* of the second flow channel portion 220.

In the third embodiment as well, a preferable range of the depth $L_1$ of the third flow channel portion 230 and the width $M_1$ of the third flow channel portion 230 are the same as those of the first and second embodiments.

Figure 7A:
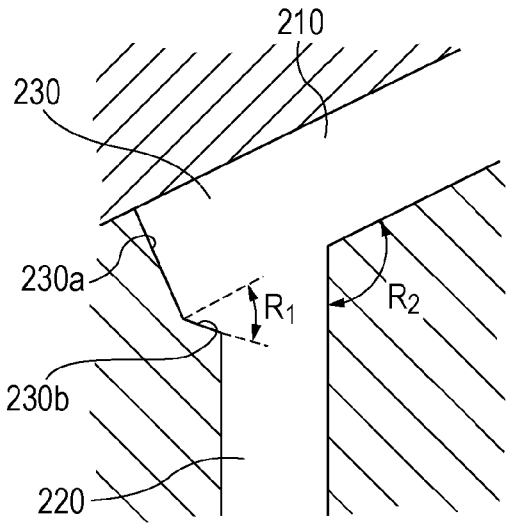
FIGS. 7A and 7B are drawings illustrating the third embodiment.
Figure 7B:
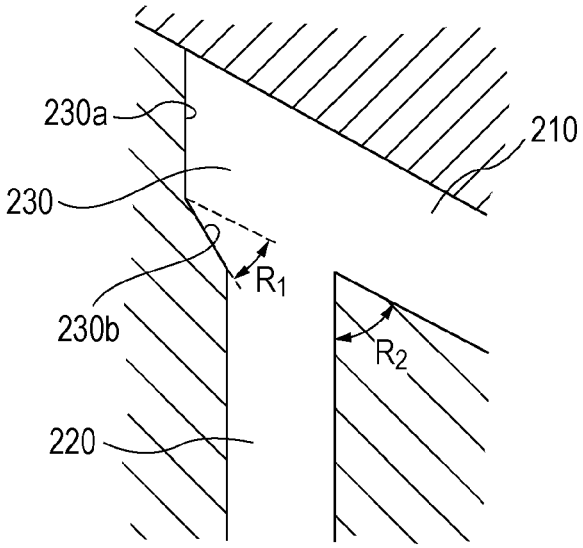

As illustrated in FIGS. 7A and 7B, the bent angle $R_2$ between the first flow channel portion 210 and the second flow channel portion 220 may be acute angles or obtuse angles instead of 90°. At this time, the wall 230*a* of the third flow channel portion 230 is preferably vertical to the direction of flow of ink of the first flow channel portion 210 and the angle of inclination $R_1$ is $0<R_1\leq R_2/2$ with respect to the bent angle $R_2$ between the first flow channel portion 210 and the second flow channel portion 220.

Figure 9A:
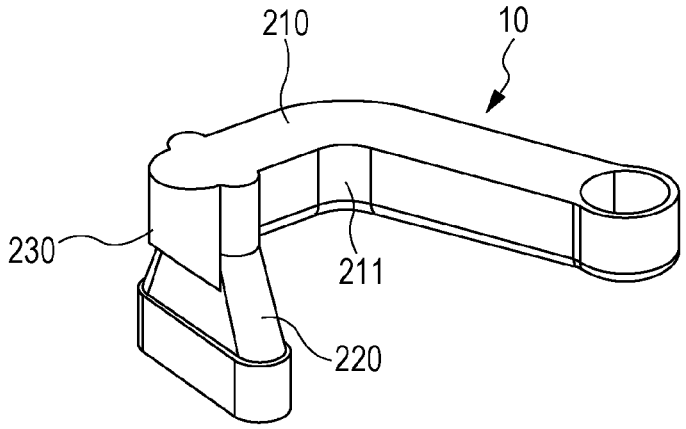
FIGS. 9A and 9B are drawings illustrating a modification of the third embodiment.
Figure 9B:
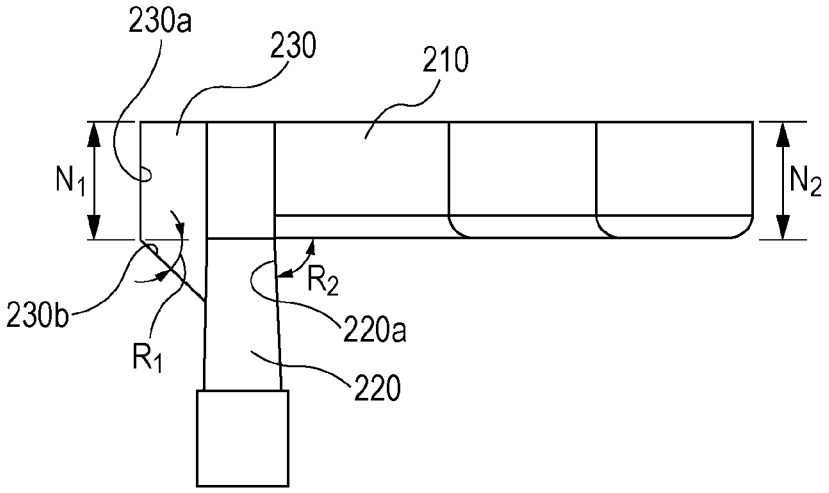

FIGS. 9A and 9B illustrate a modification of the third embodiment. In this modification, the cross section of the third flow channel portion 230 is a semicircular shape, that is, the wall 230*a* which defines the terminal end in the direction of the flow of ink of the first flow channel portion 210 is formed into a curved surface. This configuration is preferable by following reasons.

In other words, since the cross-sectional area of the third flow channel portion 230 is gradually decreased with the decreasing distance to the wall 230*a*, the kinetic energy of ink can easily concentrate toward the center portion of the wall 230*a* in the direction of the depth of the paper of FIG. 9B. The direction of flow of ink is changed subsequently by the bottom surface 230*b*, the kinetic energy of ink can easily concentrate toward the center portion of the wall 220*a* of the second flow channel portion 220, and hence the generation of the air bubble is further suppressed.

Although the first flow channel portion 210 includes a curved portion 211 in the midsection thereof, the curved portion 211 may cause a yawing moment in the direction of travel of the ink, and hence air may be involved when the ink flows to the second flow channel portion 220. Therefore, by forming the wall 230*a* of the third flow channel portion 230 into the curved surface as in this modification, the yawing moment may be attenuated, and occurrence of involvement of air may be suppressed.

In view of such circumstances described above, the cross section of the third flow channel portion 230 is not limited to the semi-circular shape (FIG. 9A), and may be any shape as long as the cross-sectional area of the third flow channel portion is decreased with the decreasing distance to the wall 230*a* and, for example, the shape of the cross section may be polygonal shape such as a triangle.

Figure 12A:
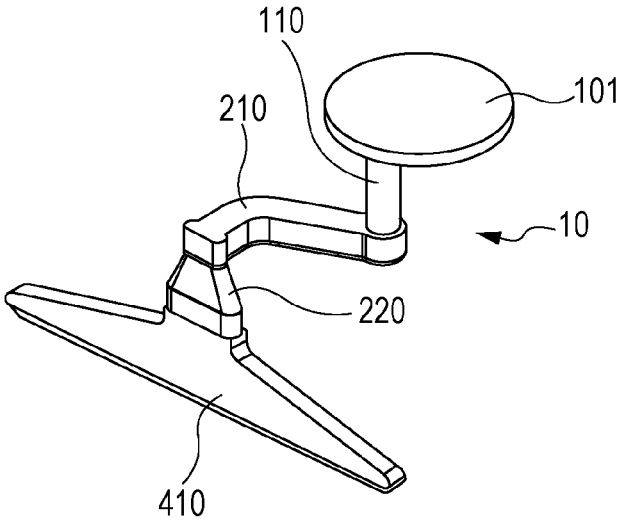
FIGS. 12A and 12B are explanatory drawings illustrating a second flow channel portion.

In the third embodiment, Although the third flow channel portion 230 is provided in the flow channel for pigment black ink, a configuration in which the third flow channel portion 230 is provided in the flow channel for color ink is also applicable. Specifically, the flow channel 10 for pigment black ink, that is, the flow channel configured to supply ink to the recording element substrate 500*a* having a long recording element row is susceptible to generation of the air bubble, the third flow channel portion 230 may be provided only in the flow channel 10 for pigment black ink. Here, the reason why the flow channel 10 for pigment black ink is susceptible to generation of air bubble will be described with reference to FIGS. 12A and 12B. FIG. 12A illustrates the flow channel 10 for pigment black ink, and FIG. 12B is a flow channel 20 for color ink.

Figure 12B:
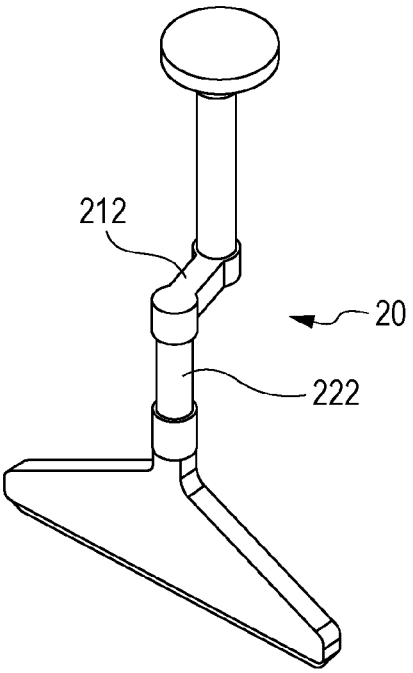

In the flow channel 20 for color ink illustrated in FIG. 12B, the cross-sectional area of the first flow channel portion 212 where ink passes and the cross-sectional area of the second flow channel portion 222 where ink passes are the same, and the cross-sectional area of the second flow channel portion 222 does not change in the direction of passage of the ink. The air bubble can hardly be generated in the flow channel having such a shape.

In contrast, in the flow channel 10 for pigment black ink illustrated in FIG. 12A, the cross-sectional area of the second flow channel portion 220 where ink passes is larger than the cross-sectional area of the first flow channel portion 210 where ink passes, and the cross-sectional area of the second flow channel portion 220 is increased in the direction of passage of the ink. In the flow channel having such a shape, separation of the boundary layer is induced, and hence the air bubble is generated easily.

Therefore, it is preferable to provide the third flow channel portion 230 specifically in the flow channel 10 having the shape illustrated in FIG. 12A to suppress generation of the air bubble. By providing the third flow channel portion 230 only in the flow channel 10 which is susceptible to generation of the air bubble, the flow channel may be disposed at a high density.

Fourth Embodiment

Subsequently, a fourth embodiment will be described with reference to FIGS. 10A to 11D.

Figure 10A:
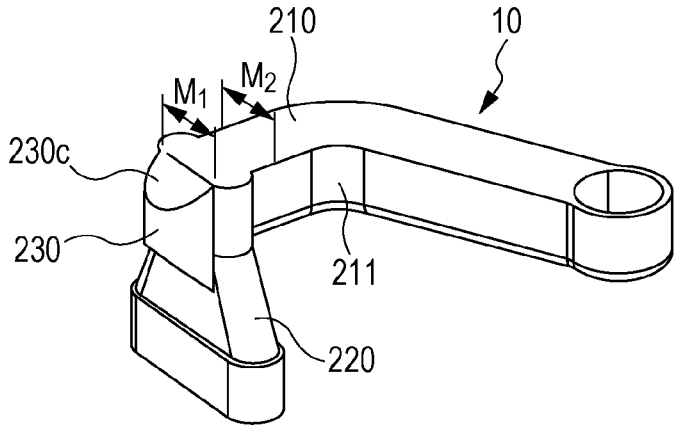
FIGS. 10A and 10B are drawings illustrating a flow channel according to a fourth embodiment.
Figure 10B:
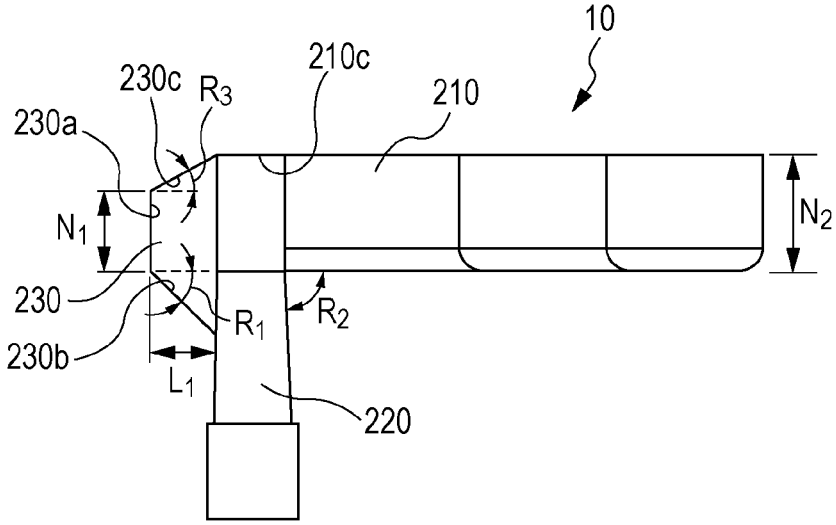
Figure 11A:
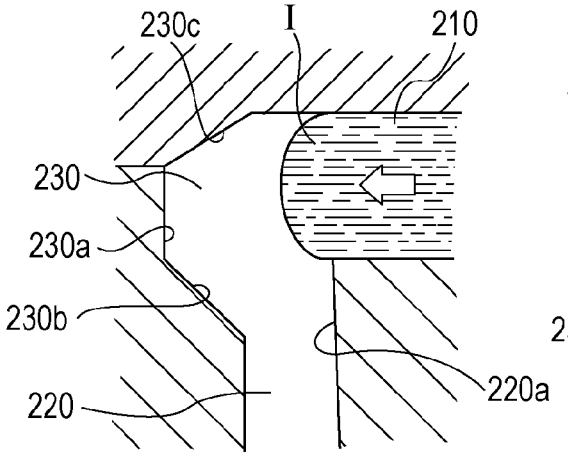
FIGS. 11A to 11D are drawings illustrating an ink flow in a flow channel according to the fourth embodiment.
Figure 11B:
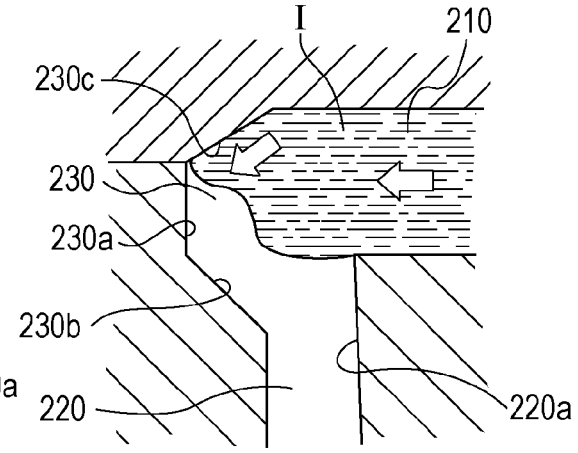
Figure 11C:
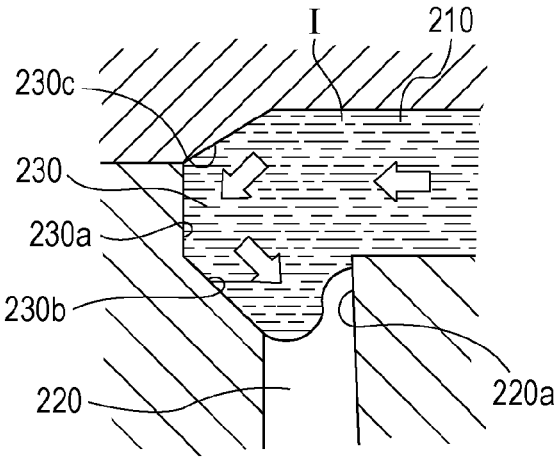
Figure 11D:
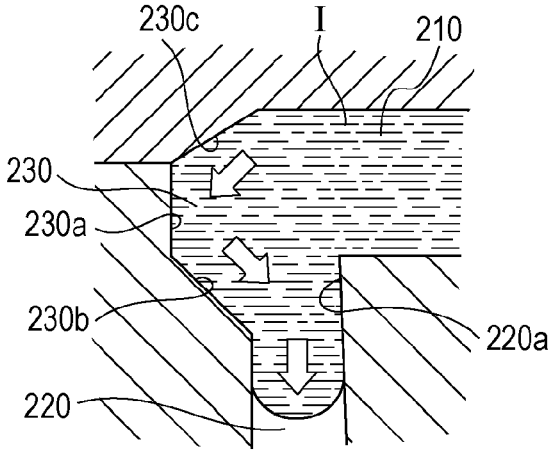

FIGS. 10A and 10B illustrate part of the flow channel 10 for the pigment black ink of the fourth embodiment. FIG. 10A is a schematic perspective view and FIG. 10B is a side view.

As illustrated in FIGS. 10A and 10B, the fourth embodiment is different from the first to third embodiments in that an upper surface 230*c* (the third wall) of the third flow channel portion 230 is an inclined surface. However, the basic configuration is the same as that of the first to third embodiments. In the description given below, the fourth embodiment in which the upper surface 230*c* of the third flow channel portion 230 is formed into an inclined surface as in the modification of the third embodiment as illustrated in FIGS. 9A and 9B will be described.

In the fourth embodiment, the upper surface 230*c* (the third wall) of the third flow channel portion 230 communicating with the first flow channel portion 210 as illustrated in FIGS. 10A and 10B is an inclined surface inclining toward an upper surface 210*c* of the first flow channel portion 210. Here, the upper surface 230*c* is inclined with respect to the direction in which the first flow channel portion 210 extends and the direction in which the second flow channel portion 220 extends.

Therefore, as illustrated in FIGS. 11A to 11D, the ink flowing through the first flow channel portion 210 moves to the upper surface 230*c* of the third flow channel portion 230, and the direction of flow of ink is changed into the direction along the inclination of the upper surface 230*c*. Furthermore, since the ink flows along the inclination of the bottom surface 230*b* of the third flow channel portion 230, the ink flows toward an area which is susceptible to the separation of the boundary layer in the wall 220*a* of the second flow channel portion 220. Accordingly, the generation of the air bubble on the wall 220*a* of the second flow channel portion 220 in the vicinity of the bent portion of the flow channel is suppressed.

The upper surface 230*c* of the third flow channel portion 230 has a configuration intending to deviate the kinetic energy of ink toward the bottom surface 230*b*. On the basis of the result of a theoretical operation performed by the inventors, an angle of inclination $R_3$ of the upper surface 230*c* is preferably set to $0<R_3\leq R_2/2$ and, more preferably, to approximately $15°\leq R_3\leq 45°$. In the fourth embodiment, the most preferable value was $R_3=30°$ when $L_1=M_2/2$, $N_1=N_2$.

In the fourth embodiment as well, a preferable range of the depth $L_1$ of the third flow channel portion 230 and the width $M_1$ and the angle of inclination $R_1$ of the third flow channel portion 230 are the same as those of the first to third embodiments.

In the first to third embodiments, generation of the air bubble is suppressed by attenuating the kinetic energy of the ink flowing in the normal direction. However, the configuration of the fourth embodiment is configured to suppress the generation of the air bubble by changing the direction of flow of ink. Therefore, the fourth embodiment is effective specifically when filling the ink into the flow channel at a high speed.

In the first to fourth embodiments, the flow channel of the ink jet recording head has been described. However, the invention is effective for the flow channel provided with a bent portion as a configuration of suppressing the generation of an air bubble, and is not limited to the flow channel of the ink jet recording head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-178276, filed Aug. 10, 2012, which is hereby incorporated by reference herein in its entirety.

What is claimed is:

1. A liquid discharge head comprising:

a liquid discharge substrate configured to discharge liquid;

a flow channel configured to supply liquid to the liquid discharge substrate, the flow channel including;

a first flow channel portion, a second flow channel portion communicating with the first flow channel portion and extending in a direction intersecting a liquid supplying direction in which the first flow channel portion extends, and a third flow channel portion provided along the liquid supplying direction of the first flow channel portion on a downstream side of a position where the first flow channel portion and the second flow channel portion communicate with each other with respect to a flow of liquid flowing in the first flow channel portion and communicating with the first flow channel portion and the second flow channel portion, the third flow channel portion including a first wall defining an end portion of the flow channel with respect to the liquid supplying direction and a second wall having an inclined surface inclining toward a wall which defines the second flow channel portion and is connected to the first flow channel portion and connecting the first wall with the second flow channel portion.

2. The liquid discharge head according to claim 1, wherein the third flow channel portion includes a third wall including another inclined surface different from the inclined surface inclining with respect to the liquid supplying direction and the intersecting direction, and connecting the first wall and the first flow channel portion.

3. The liquid discharge head according to claim 1, wherein a cross-sectional area of the third flow channel portion becomes smaller as it goes closer to the first wall, with respect to the liquid supplying direction.

4. The liquid discharge head according to claim 1, wherein the first wall has a semicircular shape when viewed in the intersecting direction.

5. The liquid discharge head according to claim 1, wherein a filter is between the flow channel and a tank configured to store liquid and the liquid discharge substrate.

6. The liquid discharge head according to claim 1, wherein the inclined surface is provided on the downstream side of the position where the first flow channel portion and the second flow channel portion communicate with respect to the flow of liquid flowing in the second flow channel portion.

7. The liquid discharge head according to claim 1, wherein the liquid discharge substrate is formed with a first element row and a second element row, both including energy generating elements, configured to generate energy for discharging liquid aligned thereon, the second element row is shorter than the first element row, another flow channel configured to supply liquid to the first element row is provided with the third flow channel portion, and the flow channel configured to supply liquid to the second element row is not provided with the third flow channel portion.

8. The liquid discharge head according to claim 1, wherein a cross-sectional area of the second flow channel portion becomes larger as it goes further with respect to a direction of the flow of liquid in the second flow channel portion.

9. A liquid discharge apparatus comprising:

liquid discharge head according to claim 1; and a suction unit configured to suck liquid, the suction unit sucking liquid from the liquid discharge substrate in a state in which an interior of the flow channel is dry to fill the flow channel with liquid.

10. A liquid discharge head comprising:

a liquid discharge substrate configured to discharge liquid;

a flow channel configured to supply liquid to the liquid discharge substrate, the flow channel including a first flow channel portion, a second flow channel portion communicating with the first flow channel portion and extending in a direction intersecting a liquid supplying direction in which the first flow channel portion extends, and a third flow channel portion provided along the liquid supplying direction of the first flow channel portion, and communicating with the first flow channel portion and the second flow channel portion, the third flow channel portion including a first wall provided at a position downstream of a third wall provided at a position on the downmost stream side with respect to a direction of a flow of liquid flowing in the first flow channel portion, which is part of the wall defining the second flow channel portion, and defining an end portion of the flow channel with respect to the liquid supplying direction, and a second wall having an inclined surface inclined toward a fourth wall provided at a position on the uppermost stream side with respect to the direction of the flow of liquid flowing in the first flow channel portion, which is part of the wall defining the second flow channel portion, and connecting the first wall with the second flow channel portion.

11. The liquid discharge head according to claim 10, wherein the third flow channel portion includes a fifth wall including another inclined surface different from the inclined surface inclining with respect to the liquid supplying direction and the intersecting direction, and connecting the first wall and the first flow channel portion.

12. The liquid discharge head according to claim 10, wherein a cross-sectional area of the third flow channel portion becomes smaller as it goes closer to the first wall with respect to the liquid supplying direction.

13. The liquid discharge head according to claim 10, wherein the first wall has a semicircular shape when viewed in the intersecting direction.

14. The liquid discharge head according to claim 10, wherein the flow channel is provided between a filter connected with a tank configured to store liquid and the liquid discharge substrate.

15. The liquid discharge head according to claim 10, wherein the inclined surface is provided on the downstream side of the position where the first flow channel portion and the second flow channel portion communicate with respect to the flow of liquid flowing in the second flow channel portion.

16. The liquid discharge head according to claim 10, wherein the liquid discharge substrate is formed with a first element row and a second element row, both including energy generating elements configured to generate energy for discharging liquid aligned thereon, the second element row being shorter in length than the first element row, another flow channel configured to supply liquid to the first element row is provided with the third flow channel portion, and the flow channel configured to supply liquid to the second element row is not provided with the third flow channel portion.

17. The liquid discharge head according to claim 10, wherein a cross-sectional area of the second flow channel portion becomes larger as it goes further with respect to a direction of the flow of liquid in the second flow channel portion.

18. A liquid discharge apparatus comprising:

liquid discharge head according to claim 10; and a suction unit configured to suck liquid, the suction unit sucking liquid from the liquid discharge substrate, in a state in which an interior of the flow channel is dry, to fill the flow channel with liquid.

* * * * *